US010895252B2

(12) United States Patent
Liao

(10) Patent No.: US 10,895,252 B2
(45) Date of Patent: Jan. 19, 2021

(54) FLUID PUMPING DEVICE

(71) Applicant: LIH YANN INDUSTRIAL CO., LTD., Taichung (TW)

(72) Inventor: Po-Lin Liao, Taichung (TW)

(73) Assignee: LIH YANN INDUSTRIAL CO., LTD., Taichung (TW)

( * ) Notice: Subject to any disclaimer, the term of this patent is extended or adjusted under 35 U.S.C. 154(b) by 170 days.

(21) Appl. No.: 16/223,530

(22) Filed: Dec. 18, 2018

(65) Prior Publication Data

US 2020/0191133 A1 Jun. 18, 2020

(51) Int. Cl.

| | |
|---|---|
| ***F04B 43/067*** | (2006.01) |
| ***F02M 37/14*** | (2006.01) |
| ***F04B 9/103*** | (2006.01) |
| ***F04B 9/14*** | (2006.01) |
| *F04B 13/00* | (2006.01) |

(52) U.S. Cl.

CPC ..... *F04B 43/067* (2013.01); *F02M 37/14* (2013.01); *F04B 9/103* (2013.01); *F04B 9/14* (2013.01); *F04B 13/00* (2013.01)

(58) Field of Classification Search

CPC .... F16J 1/003–008; F16J 15/00; F16J 15/002; F16J 15/32; F16J 15/3204; F16J 15/3208; F16J 15/3216; F16J 15/322–3236; F16J 9/00; F15B 15/1452; F04B 43/067; F04B 53/14; F04B 53/143; F04B 9/1003; F04B 9/14; F04B 13/00; F02M 37/14

See application file for complete search history.

(56) References Cited

U.S. PATENT DOCUMENTS 2,295,160 A * 9/1942 Christenson ..... F16J 15/3268 92/244
2,687,335 A * 8/1954 Bowerman ..... F04B 53/143 92/244
2,808,302 A * 10/1957 Bowerman ..... F04B 53/143 92/244
2,884,291 A * 4/1959 Whitten ..... F16J 15/3204 277/439
2,962,330 A * 11/1960 Kohl ..... F16J 1/008 92/244

(Continued)

OTHER PUBLICATIONS

Notch_Definition of Notch by Merriam-Webster; obtained on Aug. 1, 2020 from https://www.merriam-webster.com/dictionary/notch.*

*Primary Examiner* — Frederick C Nicolas
*Assistant Examiner* — Randall A Gruby
(74) *Attorney, Agent, or Firm* — Muncy, Geissler, Olds & Lowe, P.C.

(57) ABSTRACT

A fluid pumping device includes a barrel body and a piston mechanism. The barrel body has a cavity. The piston mechanism includes a piston member, a first annular plug, and a second annular plug. The piston member movably extends into the cavity. The piston member has two annular grooves where the first and the second annular plugs are disposed respectively. Each of the first the second annular plugs has an annular base section and an annular protrusion section. The annular protrusion section has a first outer annular abutting face. The annular base section has an outer annular base face. The first outer annular abutting face abuts against the inner wall of the cavity.

8 Claims, 7 Drawing Sheets

(56) References Cited

U.S. PATENT DOCUMENTS

| | | | | | |
|---|---|---|---|---|---|
| 3,540,745 | A * | 11/1970 | Flock | F16J 15/166 | 277/437 |
| 3,576,153 | A * | 4/1971 | Doutt | F16J 15/3236 | 92/244 |
| 3,678,809 | A * | 7/1972 | Doutt | F16J 15/56 | 92/86 |
| 3,774,920 | A * | 11/1973 | Sievenpiper | F16J 15/3268 | 277/468 |
| 3,785,253 | A * | 1/1974 | Sandau | F16J 1/10 | 92/181 R |
| 3,953,213 | A * | 4/1976 | Gasper | F16J 1/008 | 277/438 |
| 4,281,590 | A * | 8/1981 | Weaver | F04B 53/143 | 277/437 |
| 6,422,569 | B1 * | 7/2002 | Comes | F16B 21/16 | 277/437 |
| 7,992,483 | B2 * | 8/2011 | Tseng | F41B 11/73 | 89/130 |
| 8,505,439 | B2 * | 8/2013 | Gronau | F04B 39/0005 | 92/247 |
| 10,012,314 | B2 * | 7/2018 | Becker | F16J 15/56 | |
| 2019/0154151 | A1 * | 5/2019 | Arikawa | F15B 1/24 | |

* cited by examiner

FLUID PUMPING DEVICE

BACKGROUND OF THE INVENTION

Field of the Invention

The present invention relates to a fluid pumping device.

Description of the Prior Art

To refill oil into a vehicle, the user usually opens the oil tank and injects oil into the tank by holding an oil bottle, such as brake fluid. However, the fluid is easy to spill to waste the fluid and result pollution.

A revised fluid refilling device includes a pipe and a piston. The pipe is formed with a receiving space for receiving fluid. The piston is movable in the receiving space with respect to the pipe to push the fluid. Thereby, the user can inject fluid into the oil tank by operating the piston. A conventional piston has an O-ring sleeved thereonto. The O-ring abuts against the inner wall of the receiving space for sealing. However, when the piston moves, the O-ring slides too. Besides, the O-ring has little deformation so that gap may appear between the O-ring and the inner wall of the receiving space when the O-ring slides with respect to the piston.

SUMMARY OF THE INVENTION

The main object of the present invention is to provide fluid pumping device which is advantageous in sealing and smooth use.

To achieve the above and other objects, the fluid pumping device of the present invention includes a barrel body and a piston mechanism.

The barrel body includes a first end portion and a second end portion located at an opposite side thereof from the first end portion. The first end portion and the second end portion are aligned along an axial direction. The first end portion is formed with a flow hole. The second end portion has an opening. The barrel body further includes a cavity communicating the flow hole and the opening respectively. The piston mechanism includes a piston member, a first annular plug, and a second annular plug. The piston member is arranged through the opening and movably extending into the cavity. The piston member has two annular grooves. The first annular plug and the second annular plug are disposed in the two annular grooves respectively. The first annular plug is structurally same with the second annular plug. Each of the first annular plug and the second annular plug has an annular base section and an annular protrusion section. The annular protrusion section has a first outer annular abutting face. The annular base section has an outer annular base face. The first outer annular abutting face traverses the outer annular base face. The first outer annular abutting face abuts against an inner wall of the cavity to block the cavity. The annular base section of the first annular plug is closer to the second end portion than the annular protrusion section of the first annular plug is. The annular protrusion section of the second annular plug is closer to the second end portion than the annular base section of the second annular plug is.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
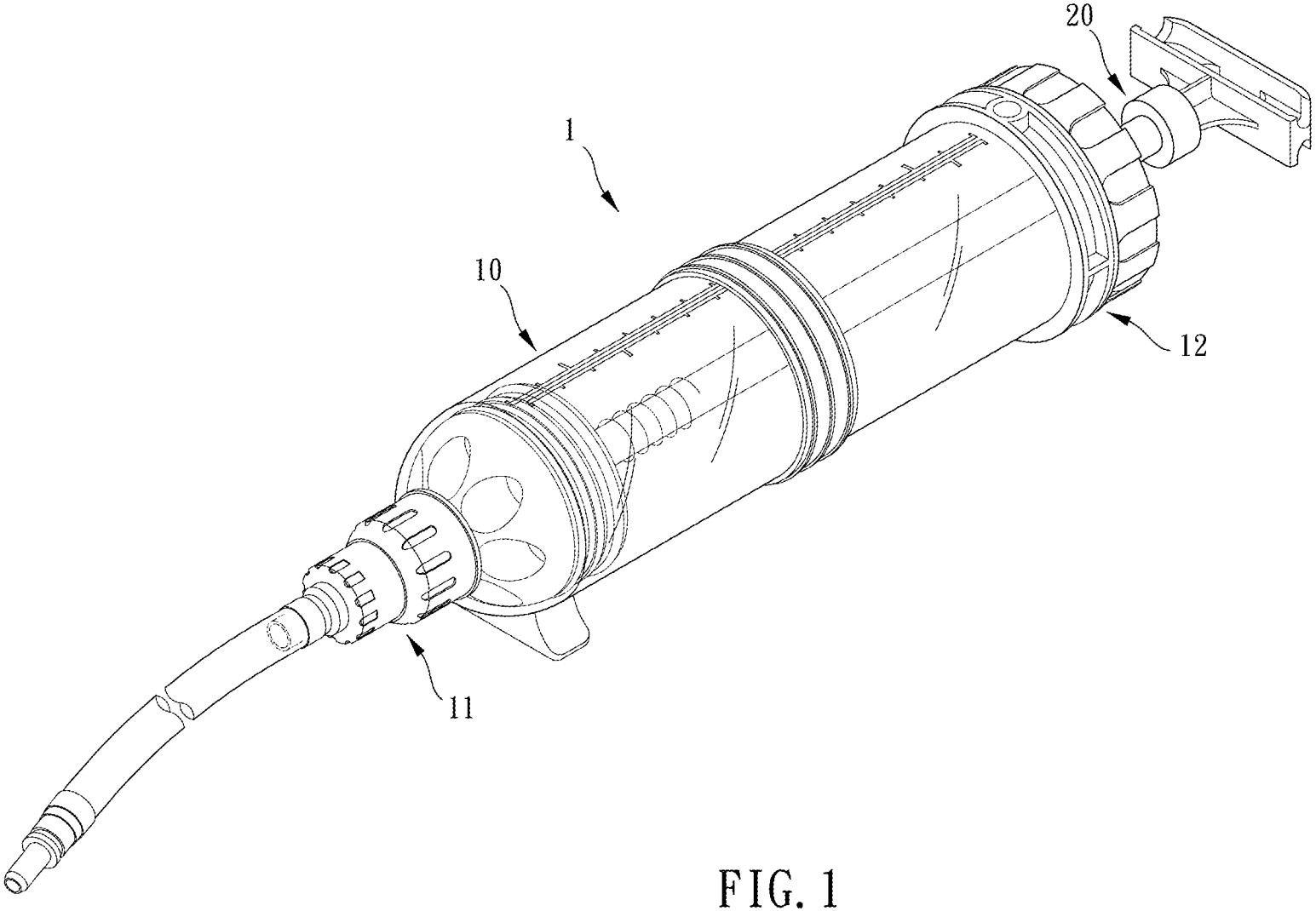
FIG. 1 is a stereogram of the present invention.
Figure 2:
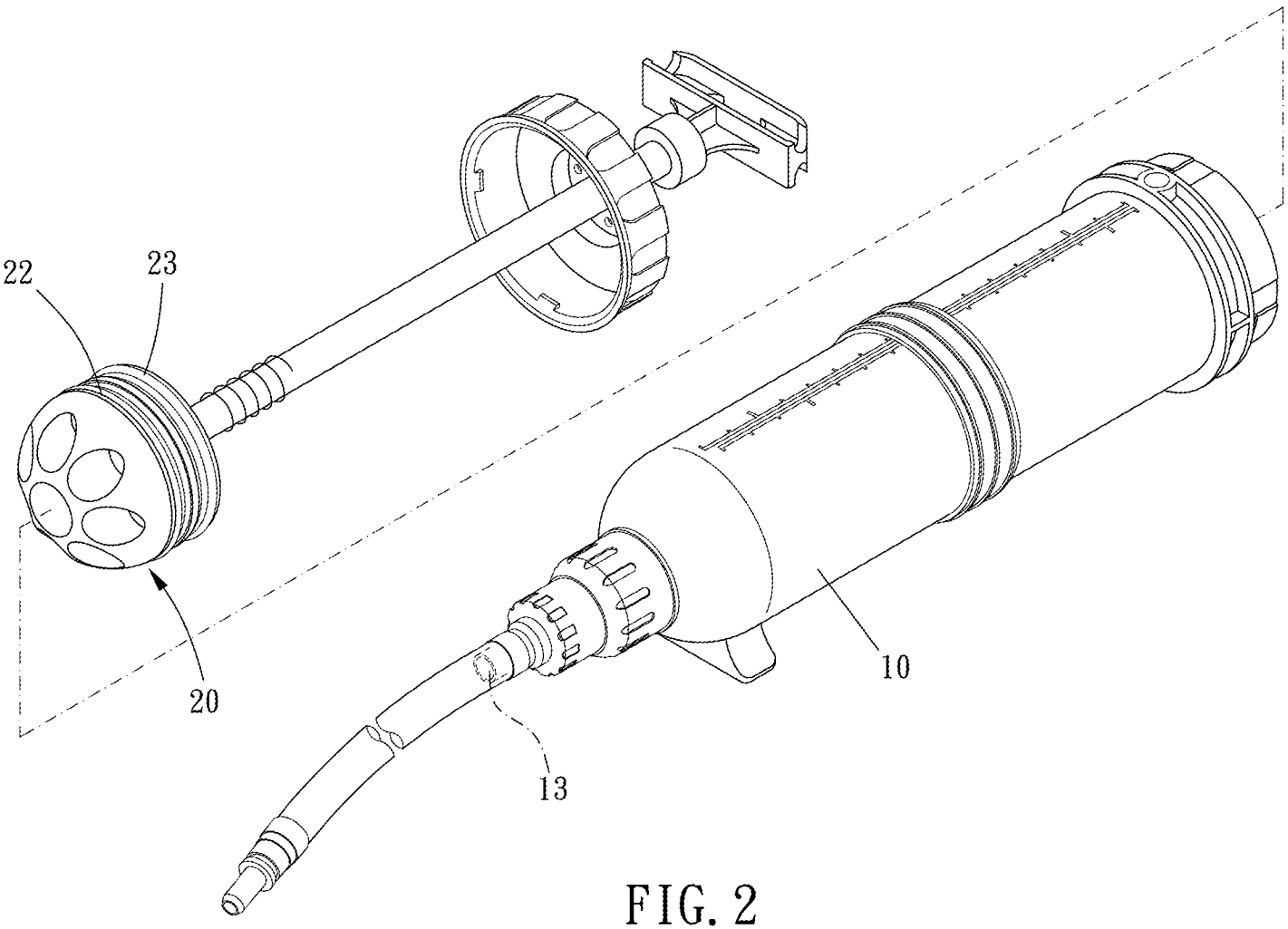
FIG. 2 is a breakdown drawing of the present invention.
Figures 3, 3A:
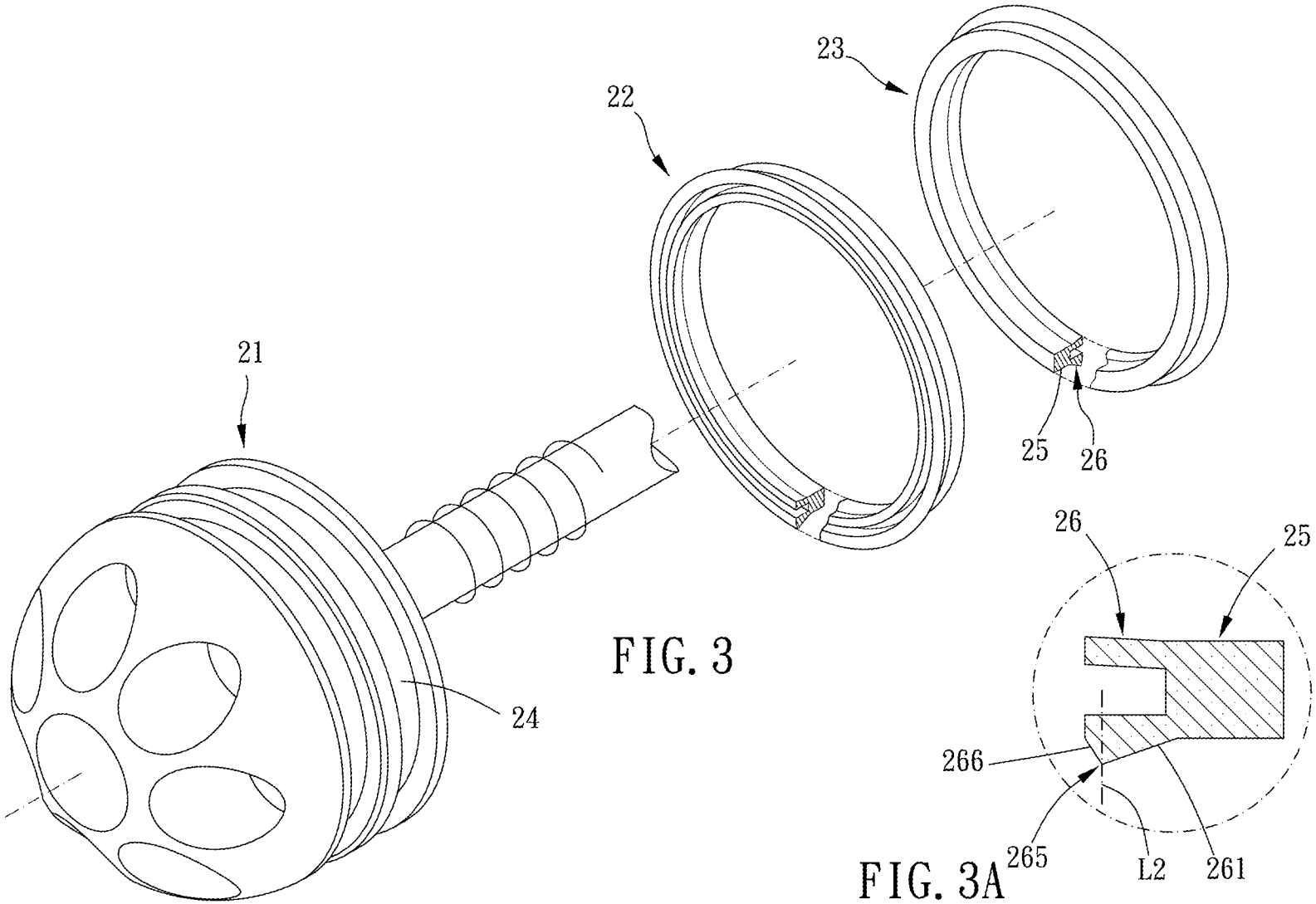
FIG. 3 is a partial breakdown drawing of the present invention.
FIG. 3A is a partial enlargement of profile of a first annular plug of the present invention.
Figure 4:
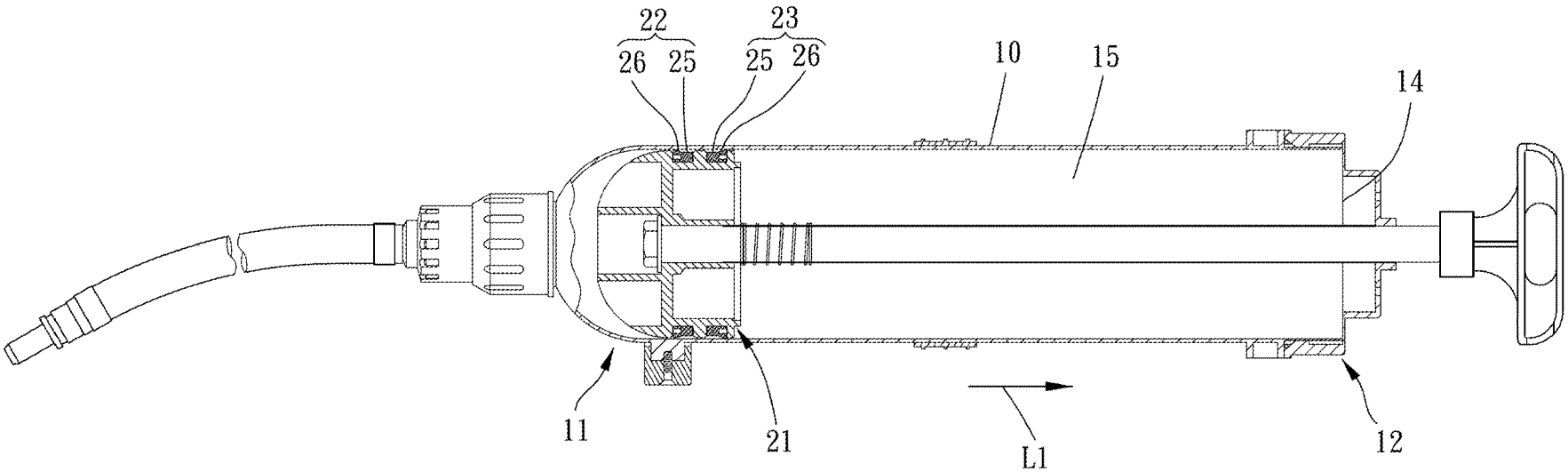
FIG. 4 is a profile of the present invention.

Please refer to FIG. 1 to FIG. 7, the fluid pumping device 1 of the present invention includes a barrel body 10 and a piston mechanism 20.

The barrel body 10 includes a first end portion 11 and a second end portion 12 located at an opposite side thereof from the first end portion 11. The first end portion 11 and the second end portion 12 are aligned along an axial direction L1. The first end portion 11 is formed with a flow hole 13. The second end portion 12 has an opening 14. The barrel body 10 further includes a cavity 15 communicating the flow hole 13 and the opening 14 respectively. The piston mechanism 20 includes a piston member 21, a first annular plug 22, and a second annular plug 23. The piston member 21 is arranged through the opening 14 and movably extends into the cavity 15. The piston member 21 has two annular grooves 24. The first annular plug 22 and the second annular plug 23 are disposed in the two annular grooves 24 respectively. The first annular plug 22 is structurally same with the second annular plug 23. Each of the first annular plug 22 and the second annular plug 23 has an annular base section 25 and an annular protrusion section 26. The annular protrusion section 26 has a first outer annular abutting face 261. The annular base section 25 has an outer annular base face 251. The first outer annular abutting face 261 traverses the outer annular base face 251. The first outer annular abutting face 261 abuts against an inner wall of the cavity 15 to block the cavity 15. The annular base section 25 of the first annular plug 22 is closer to the second end portion 12 than the annular protrusion section 26 of the first annular plug 22 is. The annular protrusion section 26 of the second annular plug 23 is closer to the second end portion 12 than the annular base section 25 of the second annular plug 23 is. Thereby, the piston member 21 has a good performance of sealing and is able to move smoothly. In addition, the first annular plug 22 and the second annular plug 23 are firmly arranged in the annular grooves 24 to prevent from sliding. In the present embodiment, the first annular plug 22 and the second annular plug 23 are made of elastic material such as rubber. In other possible embodiments, the first annular plug and the second annular plug can be made of other elastic materials.

In the present embodiment, the first annular plug 22 is closer to the first end portion 11 than the second annular plug 23 is. In other possible embodiments, the second annular plug can be closer to the first end portion than the first annular plug is to improve sealing.

Besides, an angle θ between the first outer annular abutting face 261 and the outer annular base face 251 is larger than 90 degrees so that the first outer annular abutting face 261 is easier to swing (or deform) and restore with respect to the outer annular base face 251.

The first outer annular abutting face 261 of the first annular plug 22 and the first outer annular abutting face 261 obliquely extend inward along the axial direction L1. The first outer annular abutting face 261 of the first annular plug 22 faces the second end portion 12, and the first outer annular abutting face 261 of the second annular plug 23 faces the first end portion 11 so as to be easier to deform for sealing.

An extension size of the annular base section 25 along the axial direction L1 is larger than or equal to an extension size of the annular protrusion section 26. Thereby, the first annular plug 22 and the second annular plug 23 can be firmly disposed in the annular grooves 24 for sealing.

The annular protrusion section 26 further includes a compression portion 262 and an outer annular arm 263 corresponding to the compression portion 262. The outer annular arm 263 is radially swingable toward the compression portion 262. The outer annular arm 263 is formed with the first outer annular abutting face 261. In the present embodiment, the compression portion 262 is a recess. In other possible embodiments, the compression portion can be made of elastic material other than that of the outer annular arm to be compressible and deformable to swing radially with respect to the annular base section. Preferably, the annular protrusion section 26 further includes an inner annular arm 264 abutting against a bottom of one of the annular grooves 24. The compression portion 262 is arranged between the inner annular arm 264 and the outer annular arm 263 for better support.

Figure 5:
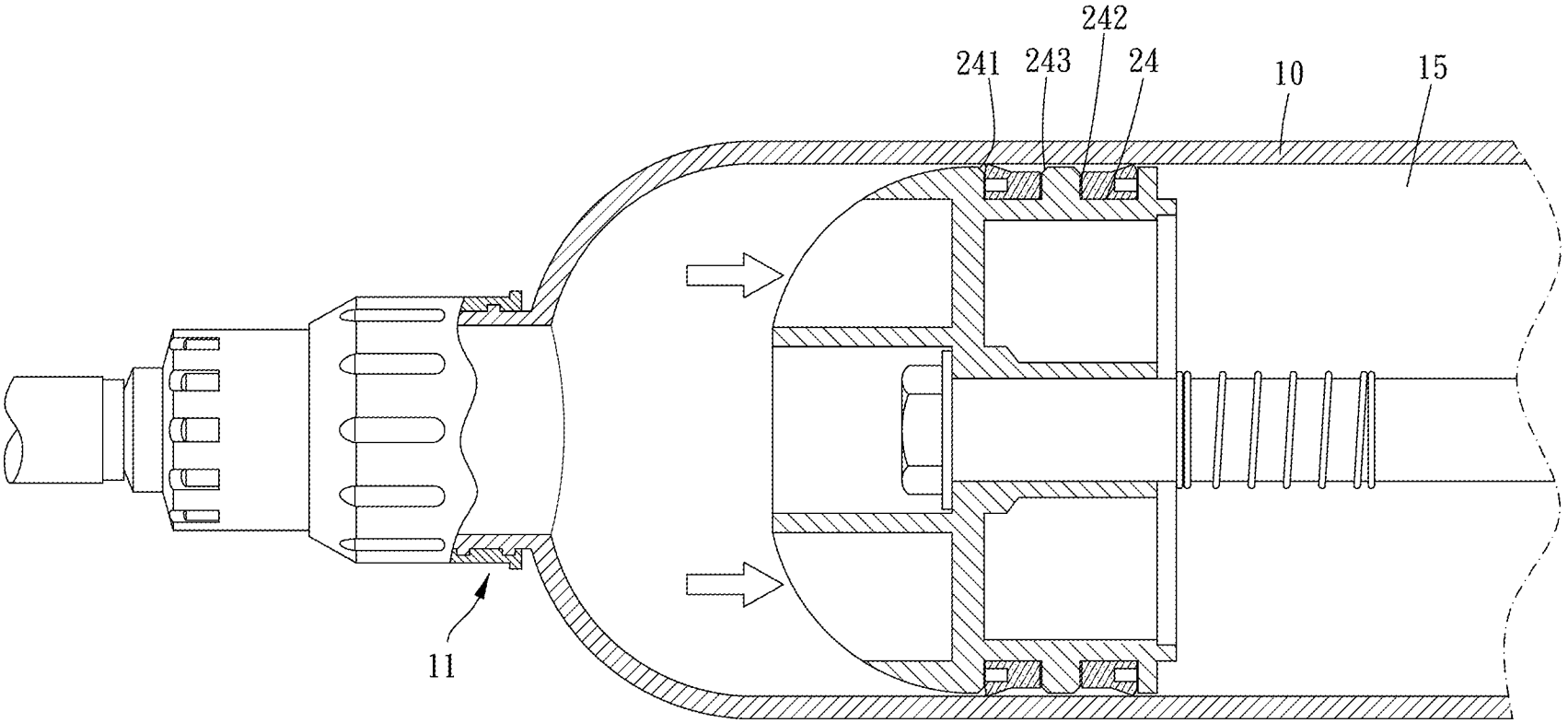
FIG. 5 is an illustration of the present invention.
Figure 6:
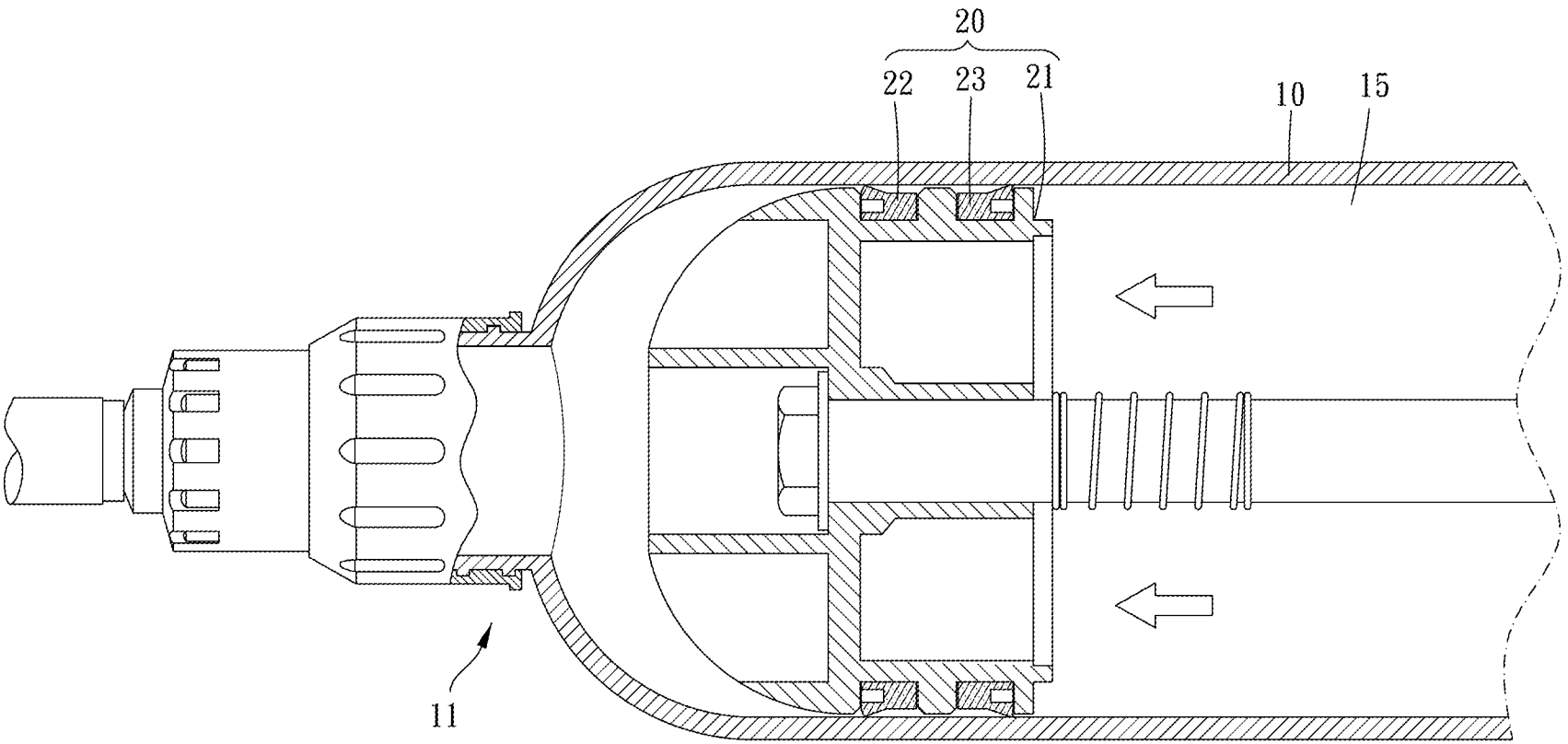
FIG. 6 is an other illustration of the present invention.
Figure 7:
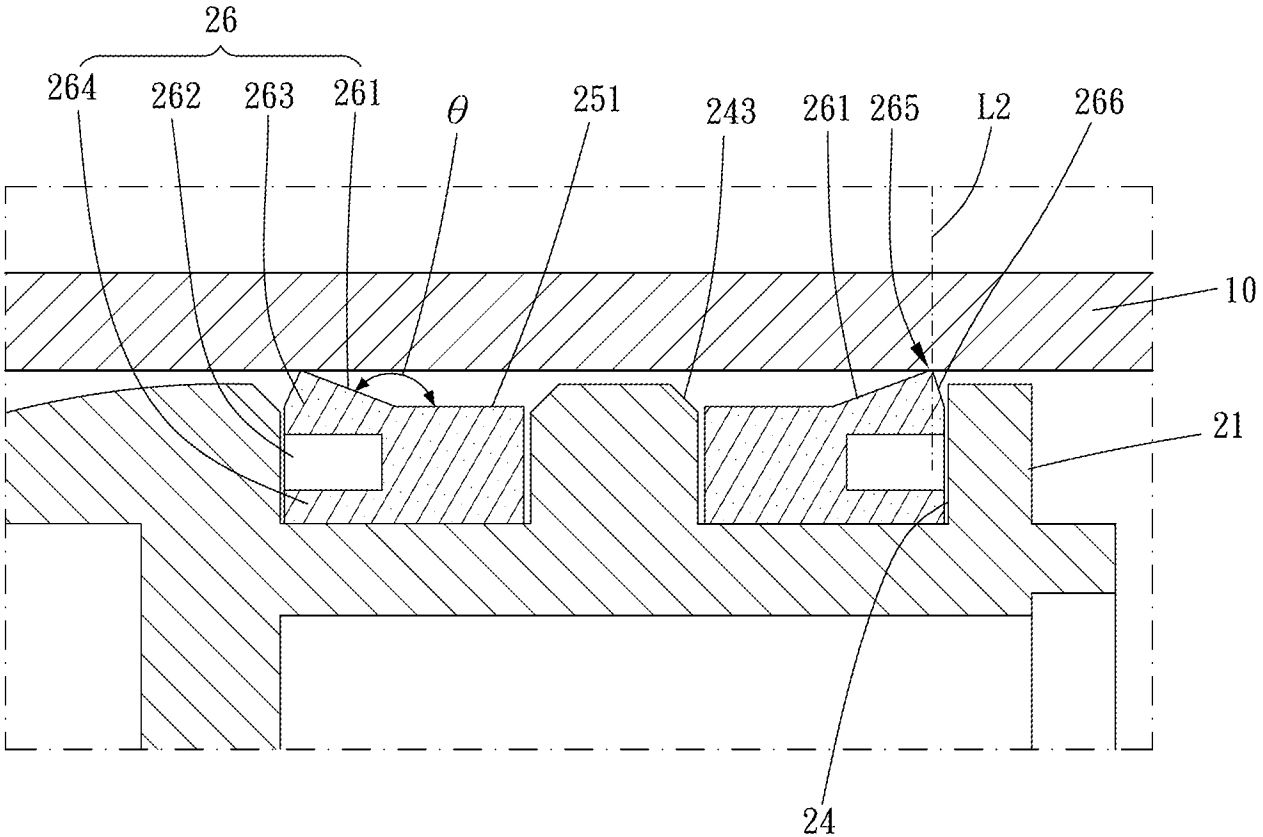
FIG. 7 is a partial enlargement of FIG. 6.

More specifically, a radially extending reference line L2 passes through a top portion 265 of the annular protrusion section 26. The annular protrusion section 26 has the first outer annular abutting face 261 and a second outer annular abutting face 266 at two sides of the reference line L2. The second outer annular abutting face 266 is located at an opposite side of the annular protrusion section 26 from the first outer annular abutting face 261. An extension size of the first outer annular abutting against face 261 along the axial direction L1 is larger than an extension size of the second outer annular abutting face 266 along the axial direction so that they have different deformations to achieve different performances of sealing. Specifically, the second outer annular abutting face 266 has a greater slope than a slope of the first outer annular abutting face 261. The second outer annular abutting face 266 of the first annular plug 22 faces the first end portion 11, and the second outer annular abutting face 266 of the second annular plug 23 faces the second end portion 12 to improve sealing. More specifically, each of the first outer annular abutting face 261 and the second outer annular abutting face 266 is resilient. When the piston member 21 moves toward the second end portion 12 as shown in FIG. 5, the second outer annular abutting face 266 of the second annular plug 23 rubs with the inner wall of the cavity 15 to bend to increase the contact area with the inner wall of the cavity 15. On the contrary, as shown in FIG. 6, the second outer annular abutting face 266 rubs with the inner wall of the cavity 15 to bend so as to increase the contact area with the inner wall of the cavity 15.

The annular base section 25 has a radial cross-section which is substantially rectangle for positioning. The top portion 265 is substantially cone-shaped and is expanding inward to prevent from over-deformation and to reduce the friction to the inner wall of the cavity 15. In other possible embodiments, the top portion can be arc-shaped or flat.

Each of the annular grooves 24 has a notch 241 which is radially open. The annular base section 25 extends not over the notch 241 so that the first annular plug 22 and the second annular plug 23 are prevented from leaving the annular grooves 24. Preferably, each of the annular grooves 24 has two lateral walls 242 facing each other. The two lateral walls 242 face the axial direction. Each of the lateral walls 242 has an inclined guiding face 243 so that the first annular plug 22 and the second annular plug 23 are easy to install or detach.

In conclusion, the first annular plug and the second annular plug disposed in the two annular grooves with the annular base section and the annular protrusion section help seal and anti-leaking. Besides, the fluid pumping device can suck smoothly.

What is claimed is:

1. A fluid pumping device, including:

a barrel body, including a first end portion and a second end portion located at an opposite side thereof from the first end portion, the first end portion and the second end portion being aligned along an axial direction, the first end portion being formed with a flow hole, the second end portion having an opening, the barrel body further including a cavity communicating the flow hole and the opening respectively;

a piston mechanism, including a piston member, a first annular plug, and a second annular plug, the piston member being arranged through the opening and movably extending into the cavity, the piston member having two annular grooves, the first annular plug and the second annular plug being disposed in the two annular grooves respectively, the first annular plug being structurally same with the second annular plug, each of the first annular plug and the second annular plug having an annular base section and an annular protrusion section, the annular protrusion section having a first outer annular abutting face, the annular base section having an outer annular base face, the first outer annular abutting face traversing the outer annular base face, the first outer annular abutting face abutting against an inner wall of the cavity to block the cavity, the annular base section of the first annular plug being closer to the second end portion than the annular protrusion section of the first annular plug is, the annular protrusion section of the second annular plug being closer to the second end portion than the annular base section of the second annular plug is;

wherein the annular protrusion section further includes a compression portion and an outer annular arm corresponding to the compression portion, the outer annular arm is radially swingable toward the compression portion, the outer annular arm has the first outer annular abutting face;

wherein the annular protrusion section further includes an inner annular arm, the inner annular arm includes an inner annular surface which abuts, in parallel, against a bottom of one of the annular grooves, the compression portion is arranged between the inner annular arm and the outer annular arm, the outer annular arm is thicker than the inner annular arm; wherein each of the annular grooves has two lateral walk opposite to each other, the two lateral walls face the axial direction, one of two lateral walls in each groove has a guiding face which is non-perpendicular to the axial direction and non-perpendicular to the two lateral walls.

2. The fluid pumping device of claim 1, wherein each of the first outer annular abutting face of the first annular plug and the first outer annular abutting face of the second annular plug obliquely extends inward along a radial direction relative to the axial direction, the first outer annular abutting face of the first annular plug faces the second end portion, the first outer annular abutting face of the second annular plug faces the first end portion.

3. The fluid pumping device of claim 1, wherein an extension size of the annular base section along the axial direction is larger than or equal to an extension size of the annular protrusion section along the axial direction.

4. The fluid pumping device of claim 1, wherein the compression portion is a recess.

5. The fluid pumping device of claim 1, wherein an angle between the first outer annular abutting against face and the outer annular base face is larger than 90 degrees.

6. The fluid pumping device of claim 1, wherein a reference line extending radially passes through a top portion of the annular protrusion section, the annular protrusion section is formed with the first outer annular abutting face and a second outer annular abutting face at an opposite side thereof at two sides of the reference line respectively, an extension size of the first outer annular abutting face along the axial direction is larger than an extension size of the second outer annular abutting face along the axial direction.

7. The fluid pumping device of claim 6, wherein corresponding to the axial direction, the second outer annular abutting face has a greater slope than a slope of the first outer annular abutting face, the second outer annular abutting face of the first annular plug faces the first end portion, the second outer annular abutting face of the second annular plug faces the second end portion.

8. The fluid pumping device of claim 7, wherein each of the first outer annular abutting face of the first annular plug and the first outer annular abutting face of the second annular plug obliquely extends inward along a radial direction relative to the axial direction, the first outer annular abutting face of the first annular plug faces the second end portion, the first outer annular abutting face of the second annular plug faces the first end portion; an extension size of the annular base section along the axial direction is larger than an extension size of the annular protrusion section along the axial direction; the compression portion is a recess; an angle between the first outer annular abutting face and the outer annular base face is larger than 90 degrees; the annular base section has a radial cross-section which is substantially rectangle; the top portion is radially tapered outward; the first annular plug is closer to the first end portion than the second annular plug is; each of the annular grooves has a bevel, the annular base section extends not over the entire extension of the bevel; the guiding face is an inclined guiding face which is inclined relative to the axial direction and inclined relative to the two lateral walls.

* * * * *